US011230409B2

(12) United States Patent
Falvey

(10) Patent No.: US 11,230,409 B2
(45) Date of Patent: Jan. 25, 2022

(54) TOP CHIME FOR A BEVERAGE KEG

(71) Applicant: Petainer Large Container IP Limited, London (GB)

(72) Inventor: James Falvey, Bedfordshire (GB)

(73) Assignee: Retainer Large Container IP Limited, London (GB)

( * ) Notice: Subject to any disclaimer, the term of this patent is extended or adjusted under 35 U.S.C. 154(b) by 209 days.

(21) Appl. No.: 16/487,014

(22) PCT Filed: Feb. 27, 2018

(86) PCT No.: PCT/GB2018/050499

§ 371 (c)(1),
(2) Date: Aug. 19, 2019

(87) PCT Pub. No.: WO2018/154334

PCT Pub. Date: Aug. 30, 2018

(65) Prior Publication Data

US 2020/0231336 A1 Jul. 23, 2020

(30) Foreign Application Priority Data

Feb. 27, 2017 (GB) ..... 1703148
Apr. 6, 2017 (GB) ..... 1705593

(51) Int. Cl.
*B65D 8/00* (2006.01)
*B65D 1/14* (2006.01)
(Continued)

(52) U.S. Cl.
CPC ..... *B65D 7/045* (2013.01); *B65D 1/14* (2013.01); *B65D 1/46* (2013.01); *B65D 11/06* (2013.01);
(Continued)

(58) Field of Classification Search
CPC ..... F17C 2205/0308; F17C 2221/035; F17C 2205/0165; B65D 7/045; B65D 25/28;
(Continued)

(56) References Cited

U.S. PATENT DOCUMENTS 2,049,977 A 8/1936 Ross et al.
2,087,349 A 7/1937 Lucker
(Continued)

FOREIGN PATENT DOCUMENTS

CA 2966212 5/2016
CN 1956892 5/2007
(Continued)

OTHER PUBLICATIONS

Great Britain Application No. GB1703148.5 Combined Search and Examination Report dated Jun. 23, 2017, 8 pages.
(Continued)

*Primary Examiner* — Kareen K Thomas
(74) *Attorney, Agent, or Firm* — Kilpatrick Townsend & Stockton LLP

(57) ABSTRACT

The present invention relates to a top chime for a beverage keg. The top chime is configured to be readily removable from the keg, for example to enable recycling of the top chime separately to the keg. The top chime comprises a mounting portion for mounting the top chime to a keg in use, and a mounting element separate to the top chime that is configured to be assembled together with the top chime after the top chime has been moved into a mounted position with respect to the keg to thereby secure the top chime with respect to the keg. The top chime is provided with a mounting element that is configured to engage the mounting portion to thereby secure the top chime with respect to the keg. The mounting element is configured to be assembled together with the top chime by moving the mounting ele-
(Continued)

ment in a radially inward direction with respect to a longitudinal axis of the top chime.

20 Claims, 9 Drawing Sheets

(51) Int. Cl.
*B65D 1/46* (2006.01)
*B65D 25/24* (2006.01)
*B65D 25/28* (2006.01)

(52) U.S. Cl.
CPC ..... *B65D 25/24* (2013.01); *B65D 25/28* (2013.01); *B65D 25/2826* (2013.01); *B65D 25/2888* (2013.01)

(58) Field of Classification Search
CPC ..... B65D 25/2826; B65D 1/14; B65D 1/46; B65D 11/06; B65D 25/24; B65D 25/2888; B65D 2525/285; B65D 25/34; B65D 1/12; B65D 21/02; B65D 25/20; B65D 25/22; B65D 25/282; B67D 2210/00097; B67D 1/0804; B67D 1/0801; B67D 1/08; B67D 2001/0822
See application file for complete search history.

(56) References Cited

U.S. PATENT DOCUMENTS

| | | | | |
|---|---|---|---|---|
| 4,294,374 | A | 10/1981 | Ames | |
| 4,593,818 | A | 6/1986 | Schenkman | |
| 4,735,338 | A * | 4/1988 | Stancil | B65D 45/16 215/290 |
| 4,915,913 | A * | 4/1990 | Williams | A61L 2/26 220/324 |
| 5,385,259 | A * | 1/1995 | Bernstein | B65F 1/06 220/212.5 |
| 5,735,428 | A * | 4/1998 | Chern | B65D 45/24 190/120 |
| 6,662,963 | B1 | 12/2003 | Meike et al. | |
| 6,789,692 | B2 * | 9/2004 | Prezelin | B65D 45/20 190/119 |
| 7,854,344 | B2 * | 12/2010 | Suk | B65D 43/0212 220/326 |
| 11,027,879 | B2 | 6/2021 | Falvey | |
| 2008/0203102 | A1 | 8/2008 | Wauters et al. | |
| 2010/0072212 | A1 | 3/2010 | Howard et al. | |
| 2010/0116836 | A1 | 5/2010 | Kolon | |
| 2011/0180535 | A1 | 7/2011 | Apps | |
| 2014/0251940 | A1 | 9/2014 | Wauters | |
| 2016/0090215 | A1 | 3/2016 | Meinzinger | |
| 2018/0222657 | A1 * | 8/2018 | Rundin | B65D 25/282 |

FOREIGN PATENT DOCUMENTS

| | | |
|---|---|---|
| CN | 101641262 | 2/2010 |
| CN | 103797293 | 5/2014 |
| DE | 8528229 | 11/1985 |
| DE | 9320107 | 3/1994 |
| DE | 19723114 | 12/1998 |
| EP | 0661214 | 7/1995 |
| EP | 2172402 | 4/2010 |
| GB | 1127305 | 9/1968 |
| GB | 1537179 | 12/1978 |
| GB | 2001032 | 1/1979 |
| GB | 2446392 | 8/2008 |
| GB | 2446393 | 8/2008 |
| GB | 2452599 | 3/2009 |
| GB | 2481436 | 12/2011 |
| GB | 2481439 | 12/2011 |
| GB | 2490966 | 11/2012 |
| GB | 2532223 | 5/2016 |
| GB | 2541758 | 3/2017 |
| JP | 06345096 | 12/1994 |
| JP | H101141 | 1/1998 |
| JP | 2001010673 | 1/2001 |
| JP | 2003040276 | 2/2003 |
| WO | 2005113344 | 12/2005 |
| WO | 2008098935 | 8/2008 |
| WO | 2008098939 | 8/2008 |
| WO | 2011143724 | 11/2011 |
| WO | 2012174628 | 12/2012 |
| WO | 2016065486 | 5/2016 |

OTHER PUBLICATIONS

Great Britain Application No. GB1703148.5, Search Report for claims 23-40 dated Jul. 26, 2017, 2 pages.
Great Britain Application No. GB1705593.0 Combined Search and Examination Report dated Sep. 4, 2017, 7 pages.
Great Britain Application No. GB1705593.0, Search Report for claims 16-25 and 26-27 in part, dated Oct. 11, 2018, 2 pages.
International Application No. PCT/GB2018/050499, International Search Report and Written Opinion dated Jul. 23, 2018, 17 pages.
Chinese Application No. 201880014409.5, Office Action dated Oct. 10, 2020, with English Translation, 10 pages.
GB1705592.2 , "Combined Search and Examination Report", dated Sep. 22, 2017, 8 pages.
GB1705592.2 , "Examination Report", dated Mar. 27, 2018, 6 pages.
GB1705592.2 , "Search Report", Claims Searched: 31-34, dated Mar. 22, 2018, 2 pages.
GB1705592.2 , "Search Report", Claims Searched: 16-22, and 23-24 in part, dated Mar. 27, 2018, 2 pages.
GB1705592.2 , "Search Report", Claims Searched: 25-29, dated Mar. 27, 2018, 2 pages.
Application No. PCT/GB2018/050498 , International Search Report and Written Opinion, dated May 25, 2018, 13 pages.
Application No. PCT/GB2018/050501 , International Search Report and Written Opinion, dated Jul. 23, 2018, 17 pages.
U.S. Appl. No. 16/487,012 , Notice of Allowance, dated Feb. 11, 2021, 8 pages.
Chinese Application No. CN 2018800144095 , Second Office Action, with English Translation, dated May 24, 2021, 7 pages.

* cited by examiner

TOP CHIME FOR A BEVERAGE KEG

TECHNICAL FIELD

The present disclosure relates to a keg assembly, and particularly, but not exclusively, to a keg assembly comprising a keg, a top chime and a bottom chime. Aspects of the invention relate to a chime, to a keg, to a kit of parts for forming a keg assembly, to a keg assembly, and to a method of mounting a chime to a keg.

BACKGROUND

Metal kegs are commonly used in the distribution and pressurised dispensing of beverages such as draught beer. Metal kegs typically include a body that is configured to hold beverage and a neck portion extending outwardly from the top of the body that receives a closure for connection to a filling head or dispense head. Such kegs typically further include a top chime extending above the top of the body to protect the neck portion and the closure, and a bottom chime extending below the base of the body to provide a stable base for the keg. The top and bottom chimes may be integrally formed with an outer wall of the body of the keg, or alternatively formed as separate components that are attached to the body of the keg. The top chime may be provided with handles to facilitate lifting of the keg.

More recently, plastic kegs have also been used in the distribution and pressurised dispensing of beverages such as draught beer. Plastic kegs may, for example, be stretch blow mounded from a preform of PET. It is known to provide plastic kegs with a top chime and/or a bottom chime in order to provide protection to the top and/or bottom portions of the keg, as well as providing a stable base for the keg.

A top chime for a plastic keg may be formed by a pair of jaws that are configured to be assembled together with each other around a neck portion of the keg, for example as described in GB2490966. However, top chimes that are formed by a pair of jaws result in an increased parts count, and may be difficult and time-consuming to assemble correctly. In addition, a top chime may be configured to be push fitted onto a neck portion of a plastic keg and to form a permanent snap fit engagement with the neck portion of the keg. However, top chimes that are snap fitted to a keg prevent subsequent removal of the top chime from the keg, and therefore do not allow separate disposal of the top chime and the keg. In addition, a top chime may be configured to be mounted indirectly to a plastic keg by attachment to a structural sleeve extending around a body of the keg. However, in some cases it may be unnecessary and/or undesirable to include a separate structural sleeve component.

Bottom chimes may be attached directly to a base portion of a keg using an adhesive. However, fixing a bottom chime to a keg using an adhesive may be difficult and-time consuming, and results in a need to handle adhesives. In addition, attachment of a bottom chime to a keg using an adhesive may make disassembly for recycling difficult or even impossible.

It is an aim of the present invention to address disadvantages associated with the prior art.

SUMMARY OF THE INVENTION

According to a first aspect of the present invention there is provided a top chime configured to be mounted to a keg. It will be appreciated that a top chime is a device that is configured to be mounted to a top end of a keg in order to provide protection to an upper portion of the keg and/or to provide a convenient point by which the keg may be handled in use. The top chime may be configured to be gripped by a user and/or by a keg handling machine, for example during filling operations (including in a conventional steel keg filling line), transportation to an end user, storage, and use at a dispensing location.

The top chime may comprise a mounting portion for mounting the top chime to the keg in use, the mounting portion defining an aperture that is configured to receive a neck portion of the keg. The mounting portion may be generally annular.

The top chime may be configured to be removable from the keg after having been mounted to the keg, for example by pulling the top chime in an axially outward direction with respect to the keg. The top chime may be configured to permit manual removal of the top chime from the keg, optionally without requiring the use of any specific tools and/or without the application of excessive force. The top chime may be configured to be removable from the keg without causing significant damage to the top chime, the keg and/or a closure fitted to the keg. By configuring the top chime to be readily removable from the keg after use it is possible to dispose of the top chime separately to the keg, for example by recycling the top chime and the keg separately.

The top chime may be provided with a mounting element that is configured to secure the top chime with respect to the keg, for example by engaging the mounting portion of the top chime. The mounting element may be configured to at least substantially prevent movement of the top chime away from the keg in a direction aligned with the longitudinal axis of the top chime and/or the keg when the top chime has been secured to the keg. The use of a separate mounting element to secure the top chime with respect to the keg allows the top chime to be quickly, easily and securely mounted to the keg without requiring the top chime to be formed as a pair of jaws and assembled around the neck portion or attached to a separate sleeve component configured to surround the keg. The top chime may be configured to be securely mounted to the keg while the mounting element remains in a mounted position with respect to the top chime, and to be readily removable from the keg after the mounting element has been removed from its mounted position with respect to the top chime.

The mounting element may be configured to be assembled together with the top chime by moving the mounting element in a radially inward direction with respect to a longitudinal axis of the top chime, optionally in a direction that is at least substantially perpendicular to the longitudinal axis of the top chime.

The mounting element may be configured to be assembled together with the top chime by sliding the mounting element into a mounted position with respect to the top chime, for example by sliding the mounting element along an upper surface of the mounting portion.

The top chime may comprise an access aperture provided in a side face thereof. The mounting element may be configured to pass through the access aperture in order to be assembled together with the top chime. It will be appreciated that the side face of the top chime is a radially outer face with respect to the longitudinal axis of the top chime. The access aperture may, for example, be formed through an outer wall of the top chime and/or between a pair of arms connecting an outer crown portion of the top chime to the mounting portion of the top chime. The top chime may further comprise a handle located adjacent to and above the access aperture, such that the access aperture facilitates gripping of the handle by a user and/or by a keg handling machine.

The mounting element may be configured to be assembled together with the top chime after the top chime has been moved into a mounted position with respect to the keg.

The mounting element may be configured to engage a bearing surface of the mounting portion to thereby secure the top chime with respect to the keg in use. The bearing surface may be an upwardly facing surface, for example an upper surface or top face of the mounting portion. However, it will be appreciated that the bearing surface is not required to be the upper-most part of the mounting portion.

The mounting element may be configured to be located between the bearing surface of the mounting portion and a retaining feature provided on the neck portion of the keg in order to secure the top chime with respect to the keg. The mounting element may comprise a first surface that is configured to engage the bearing surface of the mounting portion and an opposing second surface that is configured to engage the retaining feature. The retaining feature may take the form of a retaining flange, and may be integrally formed with the neck portion of the keg. Alternatively the retaining feature may be an underside of a closure fitted to the neck portion of the keg.

The mounting element may comprise a collar that is configured to at least partially surround the neck portion of the keg, for example extending around at least 50% of the circumference of the neck portion of the keg.

The mounting element may comprise at least one resilient element that is configured to resist removal of the mounting element from the neck portion of the keg in a radial direction with respect to a longitudinal axis of the keg when the mounting element has been coupled to the neck portion of the keg. The mounting element may be configured to receive the neck portion of the keg with a snap fit engagement.

The top chime may comprise a lock formation that is configured to retain the mounting element in a mounted position with respect to the top chime. The lock formation may, for example, comprise a resiliently movable clip or latch that is configured to engage the mounting element in order to prevent movement of the mounting element in a radially outward direction with respect to a longitudinal axis of the top chime. The lock formation may be operable to release the mounting element from its mounted position with respect to the top chime to thereby enable removal of the top chime from the keg, for example by depressing the lock formation.

The top chime may be configured to form a reversible snap fit engagement with the neck portion of the keg.

The mounting portion may comprise a plurality of resiliently flexible tines that extend radially inwardly into the aperture. The tines may be configured to form a snap fit engagement with the neck portion of the keg, for example underneath a retaining feature such as an integral flange provided on the neck portion. However, the tines may be configured to permit removal of the top chime from the keg after the top chime has been mounted to the keg, optionally while a closure is fitted to the neck portion of the keg, for example after a mounting element used to secure the top chime with respect to the keg has been removed from its engagement with the top chime. It will be appreciated that the tines are configured to allow the top chime to be readily removed from the keg without excessive force being applied to the top chime.

The tines may act to prevent accidental dislodgement of the top chime from the keg, for example after the top chime has been moved into a mounted position with respect to the keg but before the top chime has been secured with respect to the keg by the mounting element. The tines may also act to limit the extent of axial misalignment permitted between the top chime and the keg during mounting of the top chime to the keg and/or after the top chime has been mounted to the keg. The tines may also allow for natural vertical expansion of the keg, for example at high temperatures, and may allow a degree of deflection in the top chime when pressure is applied to the top chime from the keg.

The tines may be configured to permit manual removal of the top chime from the keg, optionally without requiring the use of any specific tools, and may be configured to permit removal of the top chime from the keg without damaging the top chime, the keg or a closure fitted to the keg. However, it will be appreciated that some degree of surface scratching may still occur during removal of the top chime. In other cases the tines may be configured to be damaged during removal. For example, one or more tines may break or become permanently deformed during removal of the top chime from the keg. The tines may be the only part of the top chime that become damaged during removal of the top chime from the keg.

Each tine may comprise a curved or kinked region or a region of reduced thickness. The curved or kinked regions or regions of reduced thickness may be located adjacent to the connections between the tines and the mounting portion of the top chime, and may be configured to assist with deflection of the tines, for example as the top chime is fitted to the keg or removed from the keg. The curved or kinked regions or regions of reduced thickness may be configured to allow one or more of the tines to break or become permanently deformed during removal of the top chime from the keg. However, in other embodiments the tines may instead each have a substantially constant thickness without any curved or kinked regions, in which case the tines may still be configured to deflect sufficiently to allow removal of the top chime from the keg and/or to break or become permanently deformed, for example by selecting appropriate dimensions for the tines.

The tines may each be substantially planar, and may each extend in a plane that is perpendicular to a longitudinal axis of the top chime. The radially inner distal ends of the tines may be shaped to compliment the shape of the neck portion of the keg. Each tine may have a substantially constant width along its length. By maintaining the width of each tine along its length towards an axially inner distal end the contact areas between the tines and the neck portion of the keg may be maximised and the strength of the tines may be maintained. In some cases the top chime may include tines with differing widths, for example including one or more tines with an increased width and a wider distal end compared to other tines, in order to improve the transfer of forces between the top chime and the neck portion of the keg.

The mounting element may be configured to secure the top chime with respect to the keg independently of the tines, although the tines may assist with location of the top chime with respect to the keg during mounting of the top chime to the keg and/or after the top chime has been mounted to the keg.

The top chime may comprise a plurality of resiliently deformable contact elements that are circumferentially spaced apart around the mounting portion of the top chime. The contact elements may be configured to be resiliently deformed and to bear against an upper shoulder portion of the keg when the top chime is mounted to the keg. The contact elements may act to transfer forces between the top chime and the keg when the top chime has been mounted to the keg, for example bearing at least a portion of the weight of the keg when the keg is supported in an inverted configuration on the top chime. The contact elements may additionally act to limit impact forces experienced by the keg, for example when an impact force is imparted to the top chime. The contact elements may additionally assist with correct location of the top chime with respect to the keg during mounting of the top chime to the keg and/or after the top chime has been mounted to the keg.

The contact elements may be generally blade like in form, and may be connected to the mounting portion inboard of an outer edge of the mounting portion and adjacent to the central aperture. The contact elements may each extend downwardly and radially outwardly from the mounting portion, optionally with a curved shape that curves radially outwardly along a direction away from the mounting portion. However, it will be appreciated that part of the mounting portion, for example an outer rim of the mounting portion located outboard of the contact elements, may extend axially below the contact elements.

Each contact element may define a contact surface that is configured to bear against the upper shoulder portion of the keg, and the contact surfaces may be shaped and/or angled to compliment and/or substantially match the contour of the upper shoulder portion.

Alternatively, or in addition, the top chime may comprise a plurality of feet that are spaced apart around an outer edge of the top chime. The feet may generally take the form of pillars, may be generally rigid, and may be configured to engage a radially outer part of the upper shoulder portion of the keg. The feet may be connected to the mounting portion and/or to an outer wall of the top chime, and may be located radially outboard of the resiliently deformable contact elements.

The top chime may further comprise an outer crown portion connected to the mounting portion. The crown portion may extend axially above the mounting portion, and may form the axially upper-most part of the top chime when the top chime is in its normal orientation for use. The crown portion may be configured to surround the neck portion of the keg, and to and extend above the top of the neck portion, and optionally above the top of a closure fitted to the neck portion.

According to a further aspect of the present invention there is provided a kit of parts for forming a keg assembly, the kit comprising a keg or a preform for forming a keg, and a top chime as described above that is configured to be mounted to the keg.

The keg may be a plastic keg, and may have been blow moulded from a plastic preform, for example a PET preform. It will be appreciated that where the keg is supplied as a preform the preform may be blow moulded into a final shape by a customer, for example a beverage producer.

The keg may comprise a neck portion defining an opening of the keg, which may be configured to receive and retain a closure. The neck portion may include a retaining feature that is configured to be engaged by the mounting element. The retaining feature may be integrally formed with the neck portion, may take the form of a flange, and may extend continuously around the neck portion.

The keg may be a keg for use in the distribution and pressurised dispensing of various different beverages, including, for example, beverages such as wine, coffee or milk, or draught beer. The keg may be configured to be capable of independently withstanding pressurisation forces experienced during transportation and/or pressurised dispensing of beverage without requiring any external support structure. For example, the keg may be designed to operate at an internal pressure of 0.5 bar (gauge pressure) for use with wine, or 2 to 4 bar (gauge pressure) for use with draught beer, and may be capable of independently withstanding an internal pressure of at least 5 bar (gauge pressure).

The keg may have a capacity of at least 10 litres and/or of no more than 50 litres. The keg may have a sidewall thickness of at least 0.2 mm and/or of no more than 1 mm. The keg may have a sidewall thickness of approximately 0.5 mm measured in a main body portion, for example at an axial mid-point along the main body portion.

In some cases the keg may be provided with a wrap extending around a body portion of the keg. The wrap may be a non-structural wrap, and may be mounted to the keg independently of the top chime. The keg may comprise upper and lower circumferential protrusions that each protrude outwardly with respect to the underlying contour of the keg, and the wrap may be retained between the circumferential protrusions.

According to a further aspect of the present invention there is provided a keg assembly comprising a keg and a top chime as described above mounted to a neck portion of the keg.

According to a further aspect of the present invention there is provided a method of mounting a top chime to a keg, the method comprising assembling the top chime together with the keg such that a neck portion of the keg is received within an aperture formed through a mounting portion of the top chime, and then assembling a mounting element together with the top chime such that the mounting element secures the top chime with respect to the keg. The mounting element may engage an upwardly facing surface of the mounting portion of the top chime to thereby secure the top chime with respect to the keg. The mounting element may be assembled together with the top chime after the top chime has been moved into its final assembled position with respect to the keg.

According to a further aspect of the present invention there is provided a method of operating a keg assembly comprising keg, a top chime, and a mounting element engaged with the top chime and the keg to thereby secure the top chime with respect to the keg, the method comprising: removing the mounting element from its engagement with the top chime and the keg to thereby permit removal of the top chime from the keg; and then removing the top chime from the keg. The method may be performed after the dispensing of beverage from the keg, and optionally after the keg has been depressurised following the dispensing of beverage. The method may further include a step of recycling the top chime separately to the keg.

The method of mounting a top chime to a keg and the method of operating a keg assembly may be performed using a top chime as described above, and may include any steps associated with the normal operation of a top chime as described above.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which.

DETAILED DESCRIPTION

Figure 1A:
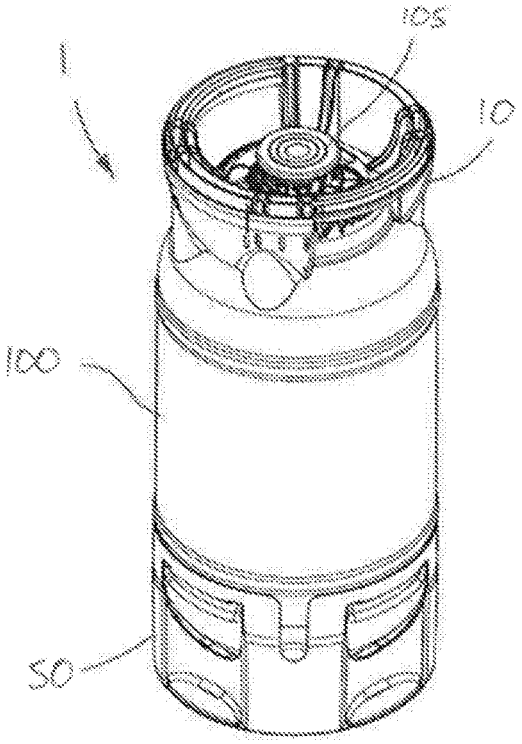
FIGS. 1*a* to 1*d* illustrates a keg assembly comprising a keg, a top chime and a bottom chime.
Figure 1B:
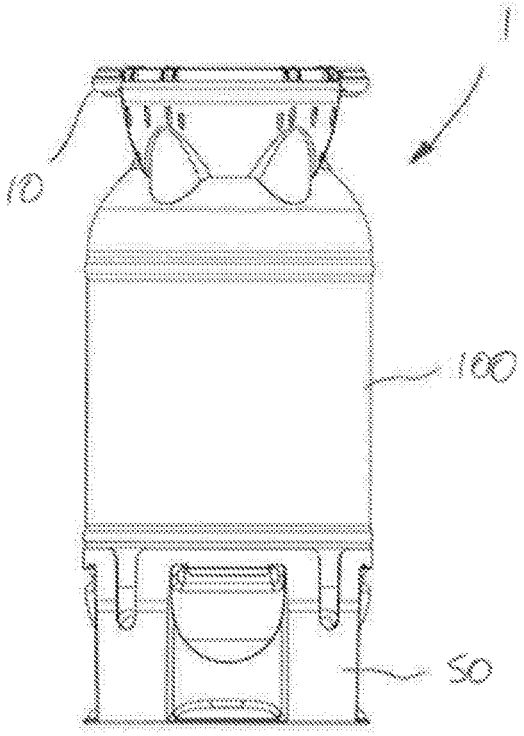
Figure 1C:
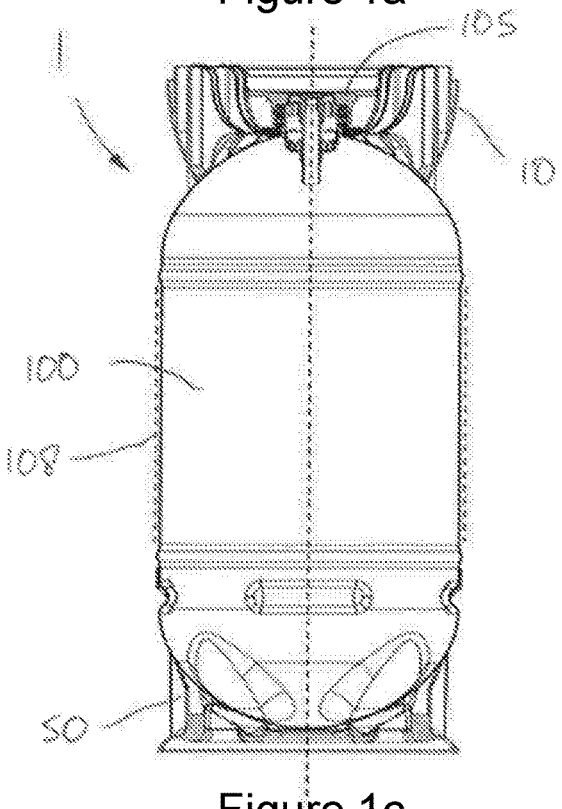
Figure 1D:
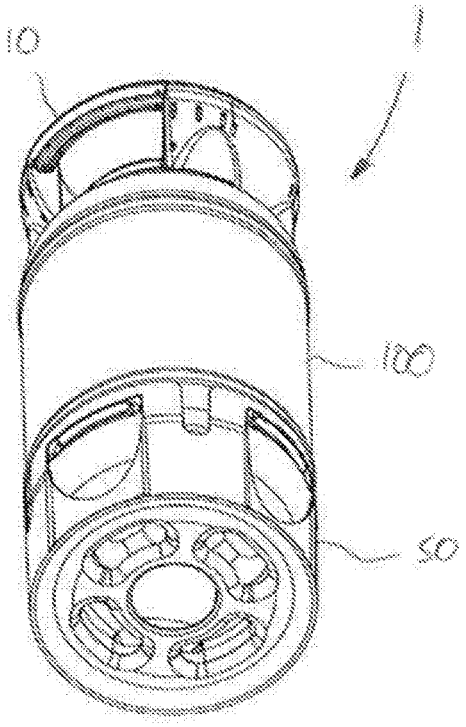
Figure 2:
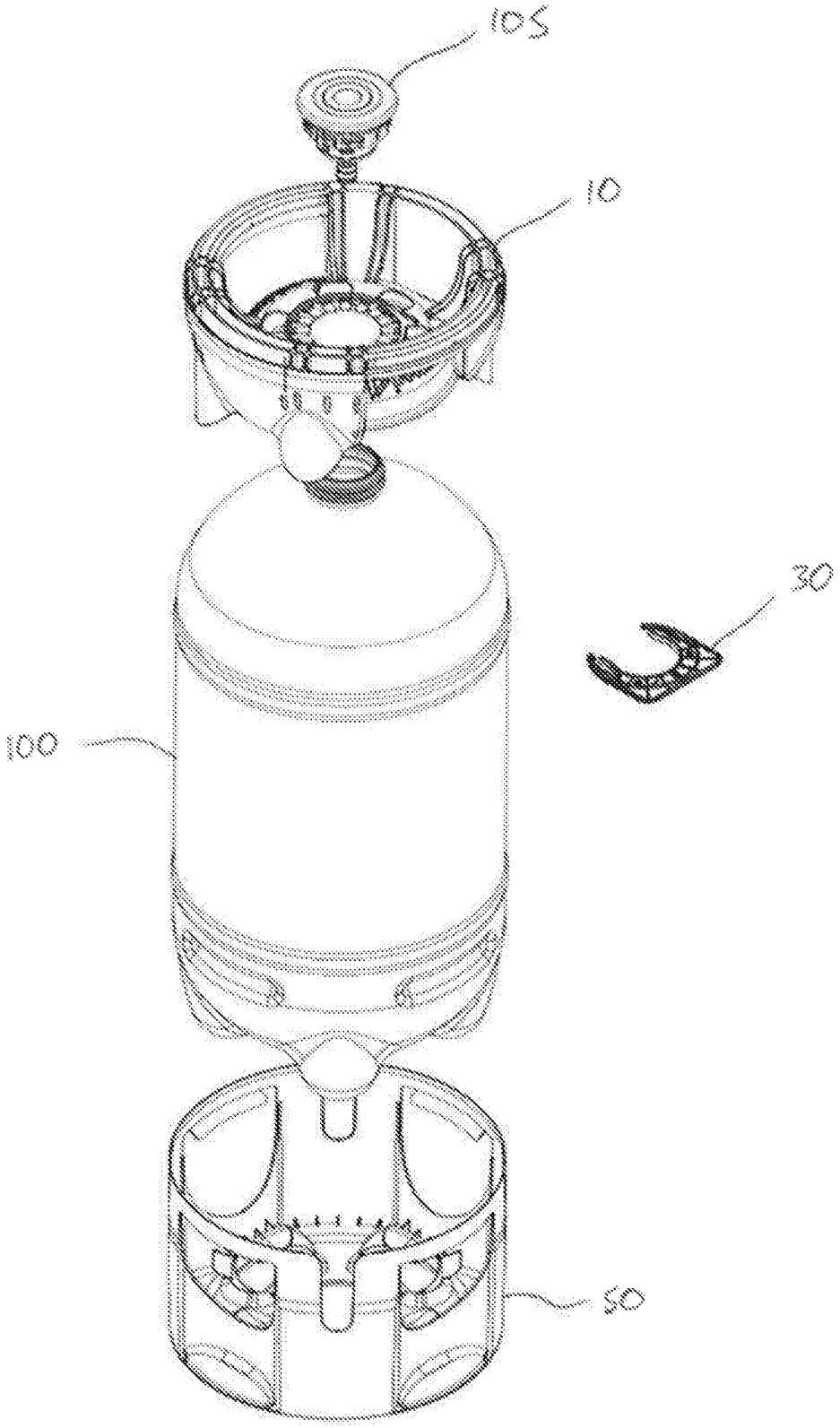
FIG. 2 illustrates an exploded view of the keg assembly of FIG. 1.
Figure 3A:
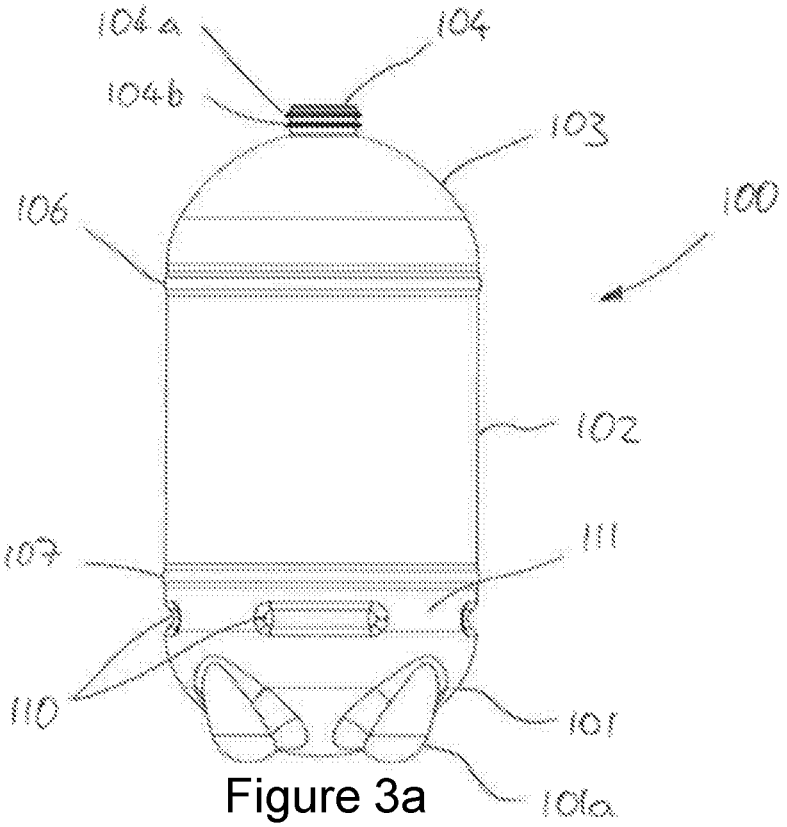
FIGS. 3*a* and 3*b* illustrate the keg in isolation.
Figure 3B:
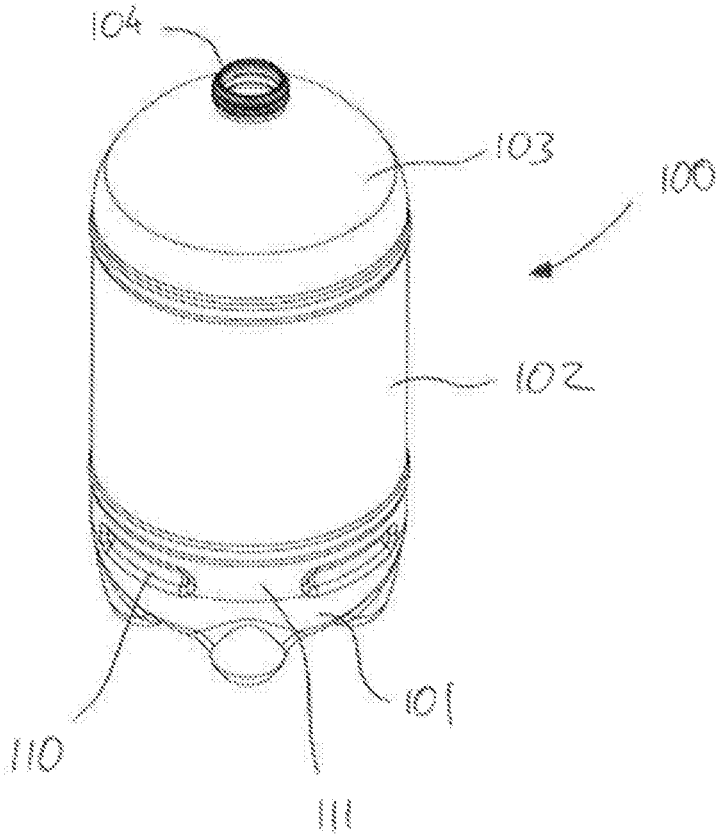

FIGS. 1*a* to 1*d* illustrate a keg assembly 1 comprising a keg 100, a top chime 10, and a bottom chime 50 in accordance with an embodiment of the present invention. An exploded view of the keg assembly 1 is illustrated in FIG. 2, and the keg 100 is illustrated in isolation in FIGS. 3*a* and 3*b*.

The keg 100 is a plastic keg that has been stretch blow moulded from a preform of PET. The keg 100 has a substantially hemispherical base portion 101 including four blister-like feet 101*a* arranged in a petaloid formation on which the keg may stand in use. The keg 100 is designed to be capable of being operated in a freestanding configuration resting on the feet 101, including during pressurised dispensing, although in the present embodiment the keg 100 is intended to be used in combination with a bottom chime 50. The keg 100 further comprises a cylindrical main body portion 102 with a substantially constant cross-section that is integrally formed with and extends upwardly from the top of the base portion 101, and a substantially hemispherical shoulder portion 103 that is integrally formed with the body portion at the top edge thereof. The base portion 101, the main body portion 102 and the shoulder portion 103 together define a body of the keg 100.

At the top of the shoulder portion 103 the keg 100 is provided with a neck portion 104 that defines an opening of the keg 100. The neck portion 104 includes an upper circumferential flange 104*a* and a lower circumferential flange 104*b*. The neck portion 104 of the keg 100 is configured to receive and retain a closure 105 (illustrated in FIGS. 1*a*, 1*c* and 2), which may be secured to the neck portion 104 of the keg 100 by a snap-fit engagement with the upper circumferential flange 104*a*. The closure 105 defines a pair of concentric flow paths into and out of the keg 100 that may be selectively opened and closed by a valve arrangement. The closure 105 includes a spear connector for connection to a dip tube or spear that extends to a location near to the bottom of the keg 100 when the closure 105 is mounted to the keg 100.

In the present embodiment the keg 100 is a keg for use in the distribution and pressurised dispensing of draught beer, and is configured to operate at a working pressure of 3 bar (gauge pressure) and to be able to independently withstand an internal pressure of at least 5 bar (gauge pressure). The keg 100 has a sidewall thickness of approximately 0.5 mm in its main body portion 102, and a capacity of approximately 20 litres.

The keg 100 comprises upper and lower annular protrusions 106, 107 that extend around the body of the keg 100 and project outwardly from the underlying contour of the keg body towards the upper and lower ends of the main body portion 102. The annular protrusions 106, 107 are configured to retain a sleeve or wrap 108 (indicated with dashed lines in FIG. 1*c*) which may be applied to the body of the keg 100 between the annular protrusions 106, 107. The wrap 108 may be a non-structural wrap, may be mounted to the keg 100 independently of the top and bottom chimes, and may be used to display branding and/or information related to the keg 100 or its contents.

The annular protrusions 106, 107 also define contact portions via which adjacent kegs stored next to each other may contact each other. The annular protrusions 106, 107 each have an outside diameter that is substantially identical to the outside diameter of the bottom chime 50 (which is slightly greater than the outside diameter of the underlying contour of the main body portion 102 of the keg 100). The annular protrusions 106, 107 therefore substantially eliminate the gaps between adjacent keg bodies at the locations of the annular protrusions when a plurality of keg assemblies 1 are stored directly adjacent to each other, thereby improving the stability of contact between adjacent keg assemblies 1.

The keg 100 further comprises a set of four retaining recesses 110 that are spaced apart around the circumference of the keg 100 at a transition region between the base portion 101 and the main body portion 102 of the keg 100. The retaining recesses 110 each extend inwardly with respect to the underlying contour of the keg 100, and are elongate in a circumferential direction with respect to the keg 100. Each retaining recess 110 extends approximately one eighth of the distance around the circumference of the keg 100. The retaining recesses 110 are separated from each other by intervening regions 111 of the keg body in which the underlying contour of the keg is not interrupted, the intervening regions 111 each extending approximately one eighth of the distance around the circumference of the keg. The cumulative length of the retaining recesses 110 is therefore approximately 50% of the circumference of the keg 100 at the location of the retaining recesses 110. The retaining recesses 110 are configured to engage corresponding engagement elements provided on the bottom chime when the bottom chime 50 is mounted to the keg 100, as described in detail below.

The keg 100 may be supplied to a user such as a beverage manufacturer as a preform. The preform may then be stored in its compact form, and may be stretch blow moulded into its final keg shape on site and on demand.

The top and bottom chimes and their interactions with the keg 100 will now be described. It will be appreciated that all references to directions made throughout this specification, such as "top", "bottom", "upper", "lower", "upwardly", "downwardly", "vertical" and "horizontal" are made with respect to a keg assembly 1 in upright orientation as illustrated in FIG. 1*b*. It will further be appreciated that the orientations of each part of the keg assembly 1 may vary in use, for example if the keg assembly 1 is stored or used in an orientation different to that illustrated in FIG. 1*b*.

Figure 4A:
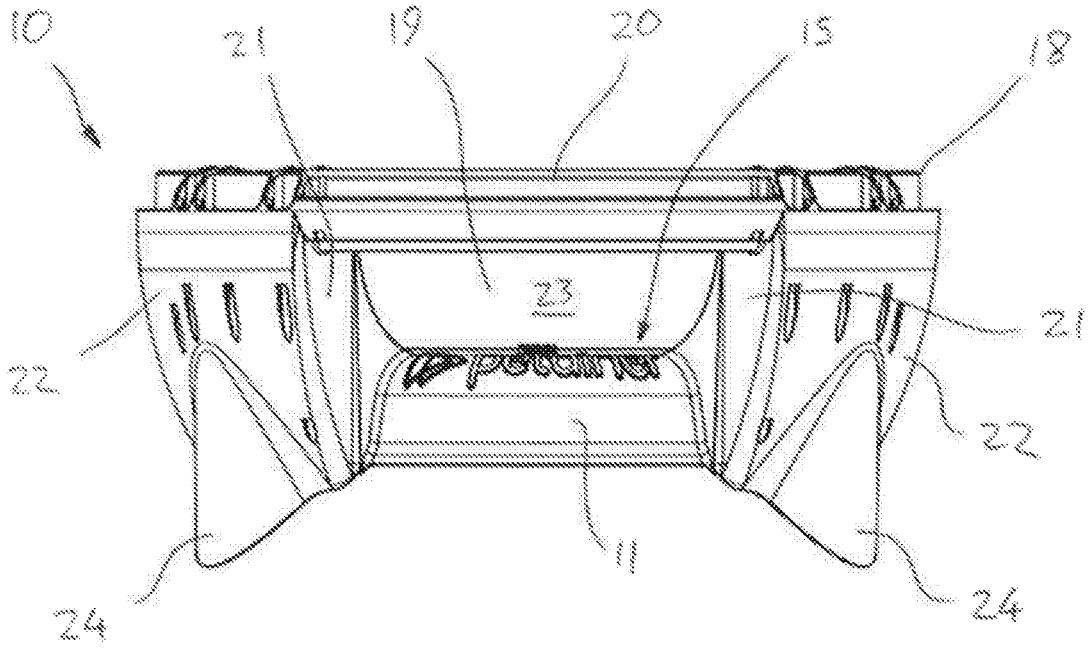
FIGS. 4*a* to 4*e* illustrate the top chime in isolation.
Figure 4B:
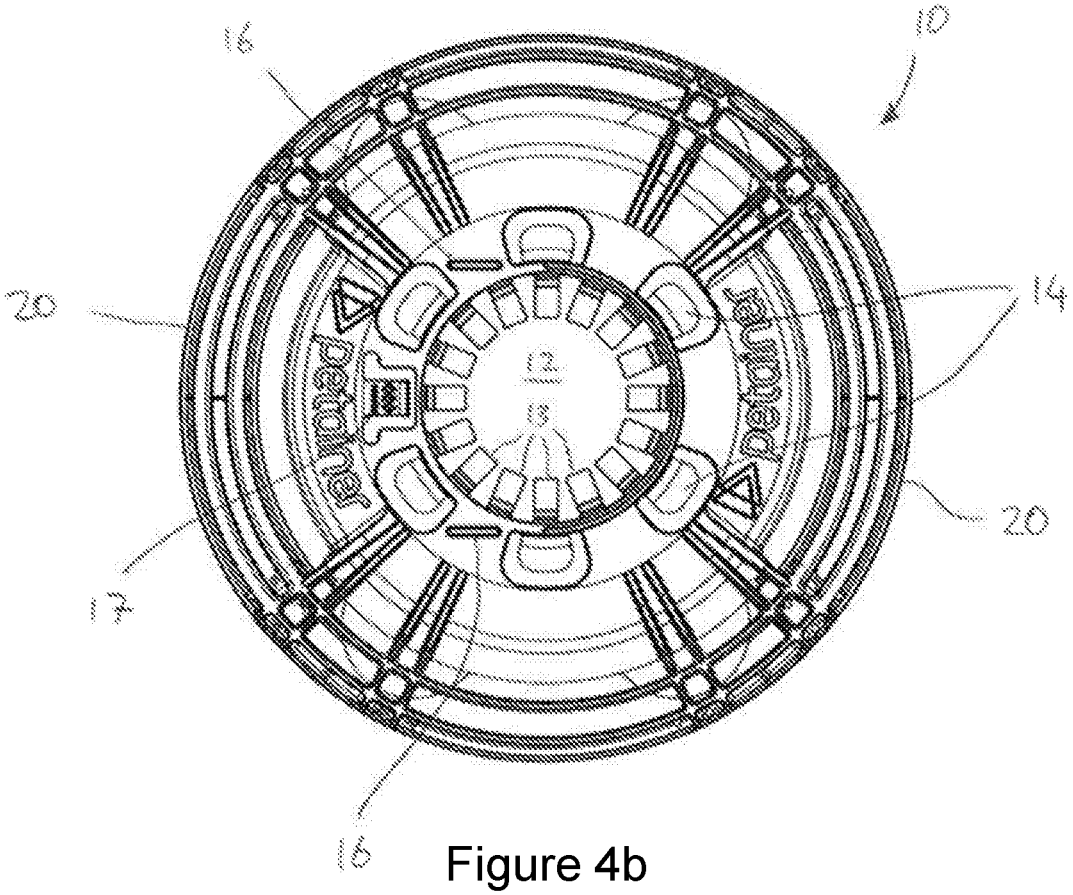
Figure 4C:
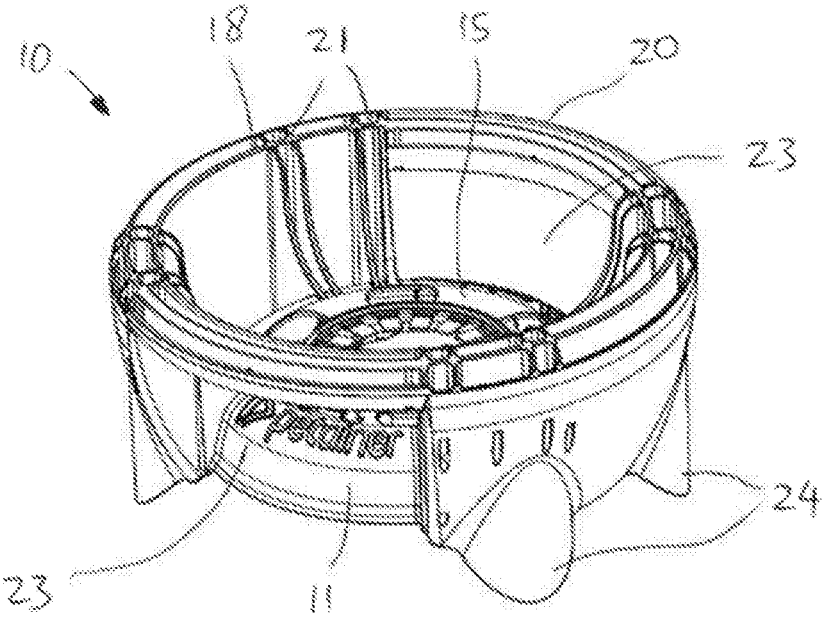
Figure 4D:
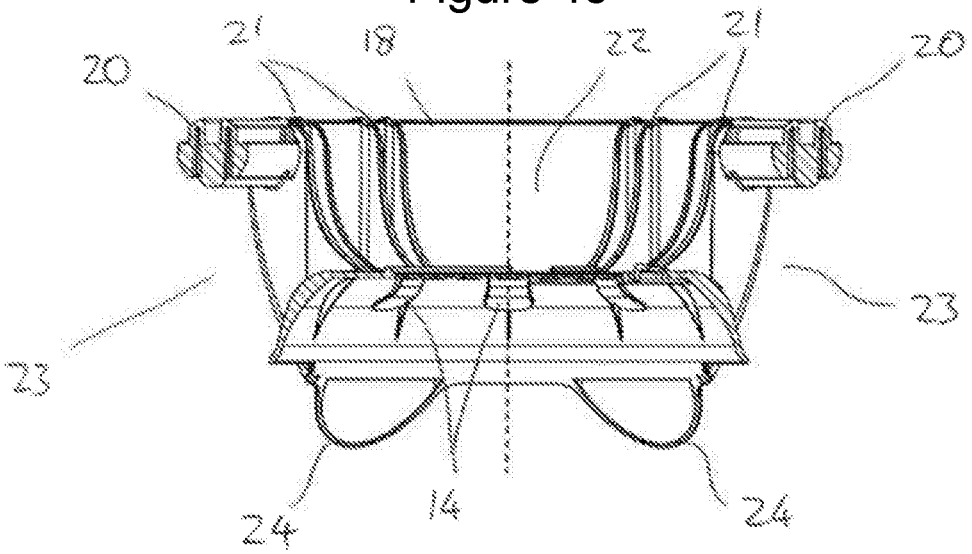

The top chime 10 is illustrated in isolation in FIGS. 4*a* to 4*e*, in which FIG. 4*a* illustrates a side view of the top chime, FIG. 4*b* illustrates a plan view from above the top chime, FIG. 4*c* illustrates a perspective view of the top chime, FIG.

Figure 4E:
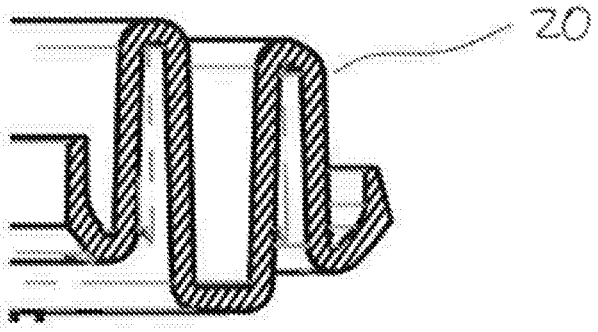

4*d* illustrates a cross-section view through the top chime, and FIG. 4*e* illustrates a cross-section view through a handle of the top chime.

The top chime 10 comprises a central mounting portion 11 or body portion that is configured for mounting the top chime 10 to the keg 100 in combination with a separate mounting element or collar 30, which is described in detail below. The mounting portion 11 is generally annular in shape and defines a central aperture 12 that is configured to receive the neck portion 104 of the keg 100.

The mounting portion 11 comprises a plurality of resiliently deformable tines 13 that are circumferentially spaced around the mounting portion 11 and extend radially inwardly into the central aperture 12. The tines 13 are separated from each other by a series of radially extending slots, and are each generally planar with a substantially rectangular shape in plan-view that terminates at a radially inner distal end. The distal ends of the tines 13 define an inner portion of the central aperture 12 with a diameter that is slightly larger than the outside diameter of the neck portion 104 of the keg 100 (excluding the flanges 104*a*, 104*b*) such that the inner ends of the tines 13 are slightly spaced apart from the radially outer surface of the neck portion 104 when the top chime 10 has been mounted to the keg 100 and is exactly centred with respect to the keg 100. However, one or more of the tines may engage the radially outer surface of the neck portion 104 if the top chime is slightly misaligned and/or if the keg has expanded under internal pressurisation. The distal ends of the tines 13 are slightly curved to compliment the shape of the neck portion 104 of the keg 100. Each tine 13 includes a kinked region or a region of reduced thickness adjacent to its connection with the mounting portion 11 of the top chime 10 that is configured to assist with deflection of the tines 13, although in other embodiments each tine 13 may have a substantially constant thickness without any kinked region.

The mounting portion 11 has a generally convex shape around its circumference, and is configured to engage the upper shoulder portion 103 of the keg 100 around its outer edge but to be spaced apart from the keg 100 inboard of its outer edge. The mounting portion 11 is additionally provided with a plurality of resiliently deformable contact elements or spring blades 14 that are spaced apart around the circumference of the mounting portion 11 and configured to engage the upper shoulder portion 103 of the keg 100.

The spring blades 14 are each connected to the mounting portion 11 adjacent to the central aperture 12, and each extend downwardly and radially outwardly from the mounting portion 11. The spring blades 14 each have a curved shape that bends radially outwardly with respect to the longitudinal axis of the top chime along their length directions away from the mounting portion 11. Each spring blade 14 defines a contact surface that is configured to continuously engage the upper shoulder portion 103 of the keg 100 when the top chime 10 has been mounted to the keg 100, the contact surfaces being angled to compliment the contour of the upper shoulder portion 103 of the keg 100. The spring blades are configured to transfer forces between the top chime 10 and the keg 100. For example, the spring blades may bear at least a portion of the weight of the keg 100 when the keg assembly 1 is placed in an inverted configuration for filling, and may reduce impact forces experienced by the keg 100 when an impact force is imparted to the top chime 10. The spring blades 14 also act to assist with correct alignment of the top chime 10 with respect to the keg 100.

The mounting portion 11 has an upwardly facing top surface 15, illustrated in plan view in FIG. 4*b*, that is configured to be engaged by the collar 30 to thereby secure the top chime 10 with respect to the keg 100 and prevent movement of the top chime 10 in an axially outward direction with respect to the keg 100. The upper surface 15 of the mounting portion 11 is provided with a pair of guide formations 16 that are configured to engage side edges of the collar 30 to guide the collar as the collar is moved into its mounted position with respect to the top chime 10. The mounting portion 11 is also provided with a resiliently movable latch or lock formation 17 that is configured to engage a rear edge of the collar 30 to prevent outward movement of the collar away from its mounted position after having been mounted to the top chime 10. The collar 30 and its interaction with the top chime are described in more detail below.

The top chime 10 further comprises an annular crown portion 18 that forms the upper-most and radially outer-most part of the top chime 10. The crown portion 18 is configured to extend above the top of the neck portion 104 of the keg 100 and the closure 105 when the top chime 10 has been mounted to the keg 100 in order to provide protection to the neck portion 104 and the closure 105. The crown portion 18 has an outside diameter that is smaller than the outside diameter of the bottom chime 50, and is configured to be received within an annular groove provided at the base of the bottom chime to facilitate stacking of keg assemblies 1.

The crown portion 18 defines a large central recess 19 into which the neck portion 104 of the keg 100 and the closure 105 protrude when the top chime 10 has been mounted to the keg 100, providing access around the closure 105. For example, the recess 19 may have a diameter that is at least twice the size of the diameter of the neck portion 104 and/or the closure 105. The crown portion 18 is configured to enable the closure 105 to be coupled to a filling head or a dispense head while the top chime 10 is mounted to the keg 100, and provides a stable base for the keg assembly 1 when in an inverted orientation, for example in a conventional steel keg filling line.

The crown portion 18 comprises a pair of handles 20 located on opposite sides of the crown portion 18 by which the keg assembly 1 may be handled in use, for example by a user or a keg handling machine. Each handle 20 has a waveform profile when viewed in cross section along a length direction of the handle (in a plane perpendicular to the length direction of the handle), as illustrated in FIG. 4*e*. The waveform profile is defined by a continuous handle element that includes a plurality of regions of inflection or peaks and troughs forming opposing upper and lower surfaces of the handle 20. The waveform profile results in handles 20 that are strong and stiff with optimised use of material, and also provides comfortable gripping surfaces to be griped by a user. The handles 20 include reinforcing webs that extend between the vertical walls of the continuous handle elements to provide reinforcement to the handles 20, for example at the location of the cross-section view illustrated in FIG. 4*d*.

The crown portion 18 is connected to the mounting portion 11 of the top chime 10 by a plurality of elongate arms 21 that extend axially upwardly and radially outwardly from the mounting portion 11 with respect to a longitudinal axis of the top chime, and by a pair of outer side walls 22 on opposing sides of the top chime 10 that extend between adjacent arms 21. The arms 21 are each formed by a plurality of webs that are arranged in planes that extend in substantially radial directions with respect to the longitudinal axis of the top chime 10. The arms 21 and the outer side walls 22 each curve outwardly with respect to the longitudinal axis of the top chime 10 between the mounting portion 11 and the crown portion 18. The top chime 10 also includes a pair of side access apertures 23 located on opposing sides of the top chime 10 that extend between adjacent arms 21 beneath the handles 20 and provide access to the interior 19 of the top chime 10 as well as facilitating use of the handles 20.

The top chime 10 further comprises a set of four rigid, pillar-like feet 24 that extend outwardly and downwardly from the outer side walls 22. The feet 24 are configured to engage an outer part of the upper shoulder portion 103 of the keg 100 when the top chime 10 has been mounted to the keg 100, for example to aid the transfer of forces between the keg 100 and the top chime 10, especially when the keg assembly 1 is placed in an inverted orientation such that the keg 100 bears downwardly on the top chime 10.

Figure 5A:
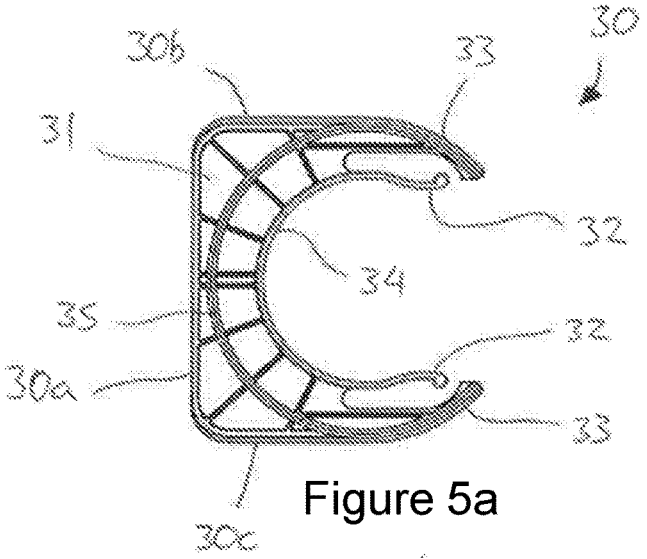
FIGS. 5*a* and 5*b* illustrate a mounting element used to secure the top chime with respect to the keg.
Figure 5B:
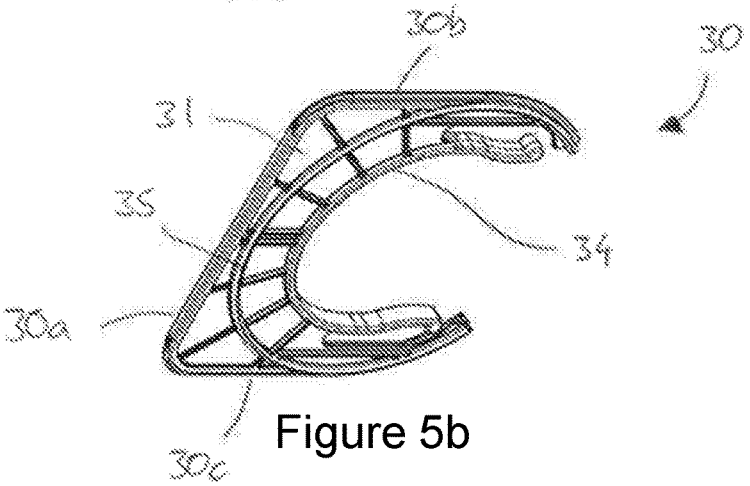

The mounting element or collar 30, which is supplied together with the top chime 10 as a separate component, is illustrated in isolation in FIGS. 5*a* and 5*b*. The collar 30 is a substantially planar component, and has a generally U-shaped or horseshoe-shaped form in plan view (as illustrated in FIG. 5*a*). The collar 30 is split or open sided and is configured to receive the neck portion 104 of the keg 100 in use. The collar 30 has a substantially straight rear outside edge 30*a* at its closed side, and a pair of substantially straight side edges 30*b*, 30*c* that extend away from the rear edge 30*a* along the sides of the collar 30.

The collar 30 comprises a pair of arms 32 that extend outwardly from a main body 31 of the collar. The inner arms 32 are configured to be resiliently deformed away from each other, and to receive the neck portion 104 of the keg 100 with a snap fit engagement. The collar 30 also comprises an outer pair of arms 33 that extend outwardly from the main body 31 adjacent to and radially outboard of the inner arms 32.

The collar 30 further comprises arcuate inner and outer contact formations 34, 35 that each extend around the collar. The inner contact formation 34 extends around the main body 31 and the inner arms 32 adjacent to the inside edge of the collar, and is configured to engage the underside of the lower circumferential flange 104*b* provided on the neck portion 104 of the keg 100 in use. The outer contact formation 35 extends around the main body 31 and the outer arms 33 outboard of the inner contact formation 34, and is configured to engage the upper surface 15 of the mounting portion 11 of the top chime 10 in use.

When it is desired to mount the top chime 10 to the keg 100, the top chime 10 is first moved into a mounted position with respect to the keg 100 with the neck portion 104 of the keg 100 protruding through the central aperture 12 in the mounting portion 11 and into the central recess 19 defined within the crown portion 18. This step may be performed after the closure 105 has been fitted to the neck portion 104, preferably before the keg 100 has been pressurised and filled with beverage. As the top chime 10 is moved into its mounted position with respect to the keg 100, the tines 13 in the central aperture 12 are deflected upwardly and outwardly with respect to the top chime 10 over the closure 105 and the lower circumferential flange 104*b*, and then snap underneath the lower flange 104*b* to prevent accidental dislodgement of the top chime 10 from the keg 100 before the top chime 10 has been secured to the keg 100 using the collar 30. The tines 13 also act to ensure that the top chime 10 is correctly centred with respect to the keg 100.

Once the top chime 10 has been moved into its mounted position with respect to the keg 100, the collar 30 is then assembled together with the top chime 10 to thereby secure the top chime 10 with respect to the keg 100. In particular, the collar 30 is passed through one of the access apertures 23 with the open side of the collar facing towards the neck portion 104 of the keg 100. Once the collar 30 has passed through the access aperture 23, the collar 30 is then slid along the upper surface 15 of the mounting portion 11 of the top chime 10 in a direction perpendicular to the longitudinal axis of the top chime 10 and the neck portion 104 of the keg 100 (as indicated by an arrow in FIG. 6) until the neck portion 104 is received within the collar 30 and the inner arms 32 form a snap fit engagement with the neck portion 104.

As the collar 30 moves towards its mounted position with respect to the top chime 10, the guide formations 16 provided on the mounting portion 11 of the top chime 10 engage the side edges 30*b*, 30*c* of the collar 30 to thereby guide the collar 30 along a defined path with respect to the mounting portion 11. When the collar 30 reaches its fully mounted position with respect to the top chime 10 the lock formation 17 provided on the mounting portion 11 of the top chime 10 snaps into engagement with the rear edge 30*a* of the collar 30 to thereby prevent outward movement of the collar 30 away from its mounted position, and the guide formations 16 act to prevent rotation of the collar 30 with respect to the top chime 10.

Figure 6:
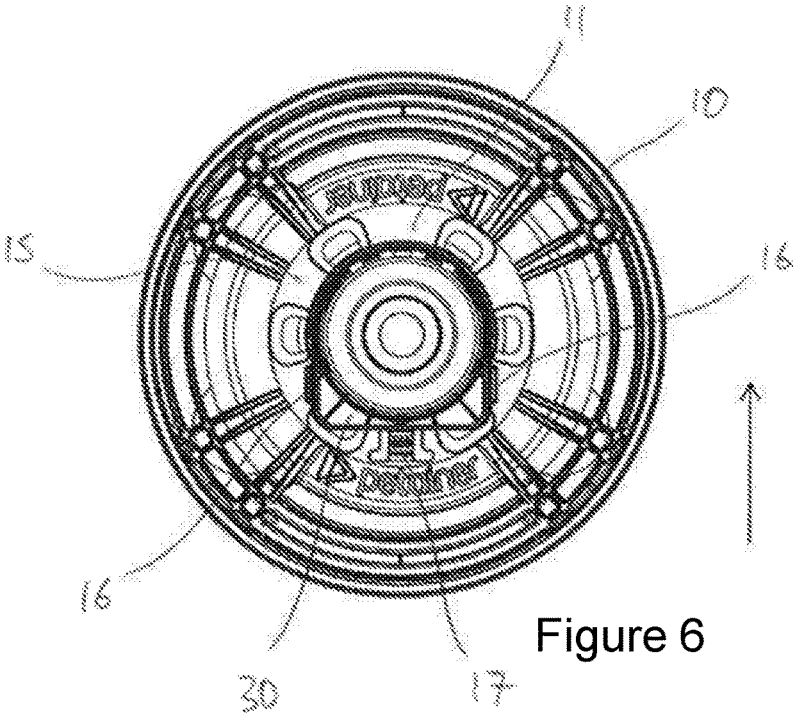
FIG. 6 illustrates a plan view of the keg assembly.

When the collar 30 has reached its fully mounted position as illustrated in FIG. 6, the collar 30 becomes sandwiched between underside of the lower circumferential flange 104*b* on the neck portion 104 of the keg 100 and the upper surface 15 of the mounting portion 11 of the top chime 10, with the inner contact formation 34 of the collar 30 engaging the underside of the lower circumferential flange 104*b* and the outer contact formation 35 engaging the upper surface 15 of the mounting portion 11. In this way the collar 30 secures the top chime 10 with respect to the keg 100 and prevents axial movement of the top chime 10 away from the keg 100. The collar 30 also acts to transfer the weight of the keg 100 to the top chime 10 when the keg assembly 1 is lifted by the top chime 10.

If it is subsequently desired to remove the top chime 10 from the keg 100, the lock formation 17 on the mounting portion 11 of the top chime 10 may be manually depressed in order to release the collar 30 and permit the collar 30 to be moved radially outwardly from its mounted position and out of its engagement with the neck portion 104 of the keg 100. The top chime 10 may then be removed from the neck portion 104 of the keg 100 by manually pulling the top chime 10 axially outwardly away from the keg 100. After the collar 30 has been removed, the tines 13 provide some resistance to removal of the top chime 10 from the keg 100. However, the tines 13 are configured to allow the top chime to be manually removed from the keg 100 without the application of excessive force and without the use of specific tools. The tines 13 may optionally be configured to allow the top chime 10 to be removed from the keg 100 without damaging the top chime 10, the keg 100 or the closure 105. However, in other cases the top chime 10 may be configured such that one or more of the tines 13 break or become permanently deformed in order to permit removal of the top chime 10 from the keg 100.

Once the top chime 10 has been removed from the keg 100 it is then possible to dispose of the keg 100, for example by crushing and recycling the keg, while the top chime 10 and the collar 30 may be recycled separately to the keg as part of a one-way keg system. If the top chime 10 can be removed from the keg without becoming significantly damaged then it may additionally be possible to retain or return the top chime 10 for subsequent use with another keg.

Figure 8:
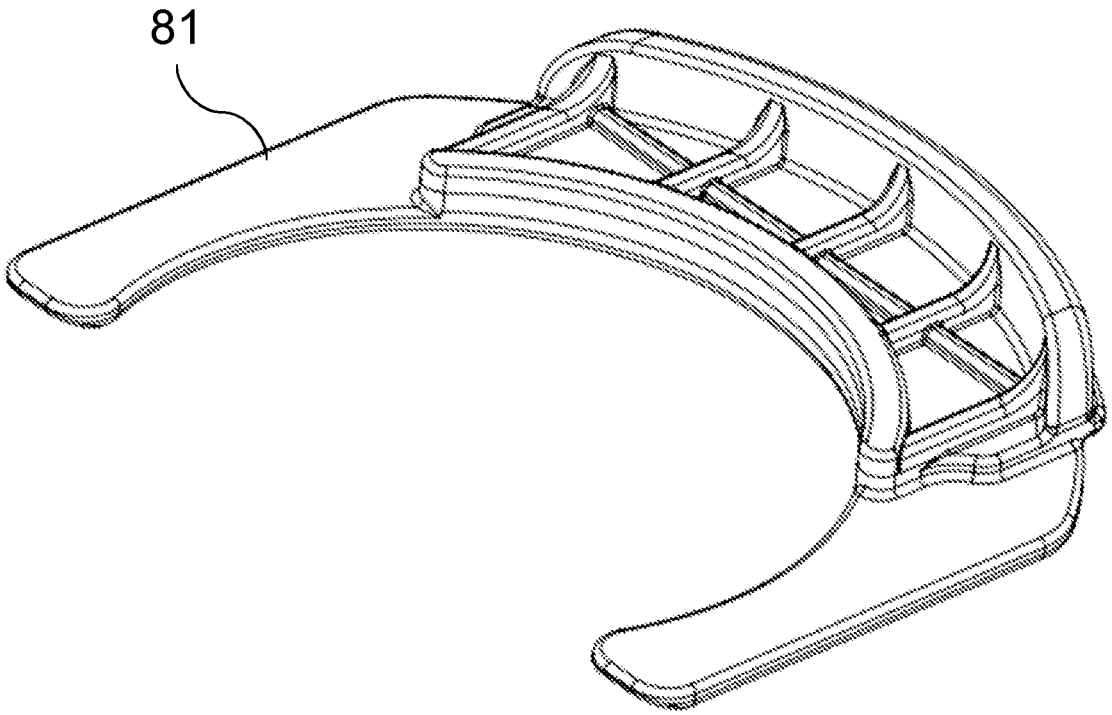
FIG. 8 illustrates a second mounting element that may be used together with the mounting element of FIGS. 5*a* and 5*b*.

FIG. 8 illustrates a second mounting element or collar insert 81 that may be used together with the collar 30 of FIGS. 5*a* and 5*b*. Like the collar 30, the collar insert 81 comprises a pair of arms that extend outwardly from a main body. The arms are configured to be resiliently deformed away from each other, and to receive the neck portion 104 of the keg 100 with a snap fit engagement.

Figure 9A:
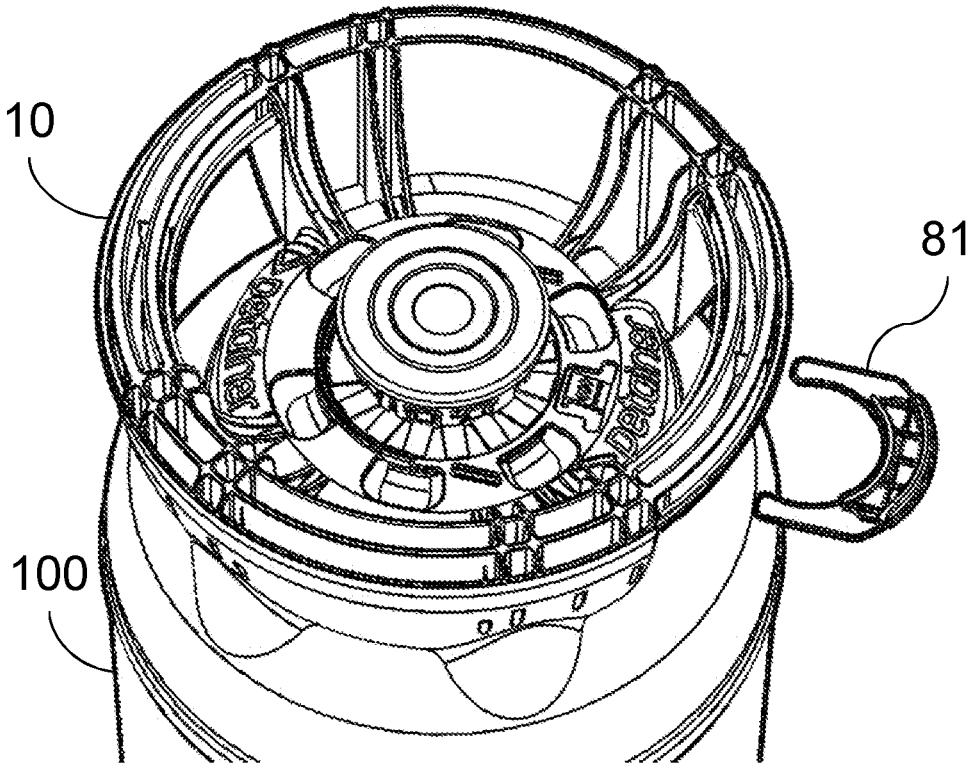
FIGS. 9*a* and 9*b* illustrate a possible method for mounting the top chime to the keg.
Figure 9B:
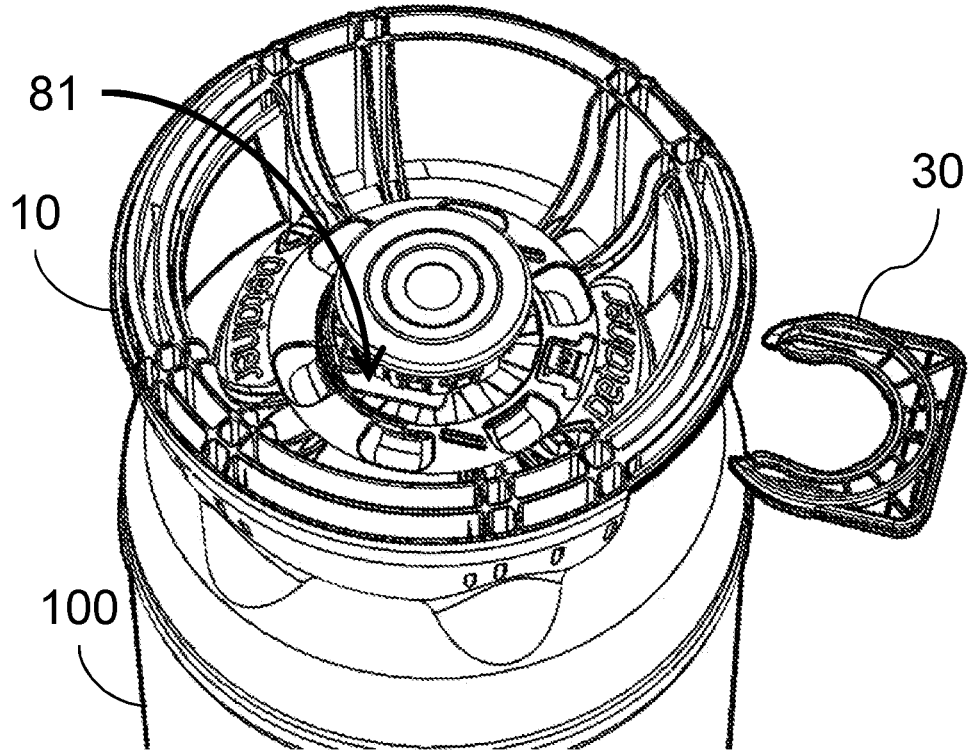

FIGS. 9*a* and 9*b* illustrate a possible method for mounting the top chime 10 to the keg 100, using both the collar 30 and the collar insert 81. After placing the top chime 10 on the shoulder portion 103 of the keg 100, the collar insert 81 is passed through one of the access apertures 23 with the open side of the collar insert 81 facing towards the neck portion 104 of the keg 100 (FIG. 9*a*). Once the collar insert 81 has passed through the access aperture 23, the collar insert 81 is then slid along the upper surface 15 of the mounting portion 11 of the top chime 10 in a direction perpendicular to the longitudinal axis of the top chime 10 and the neck portion 104 of the keg 100 until the neck portion 104 is received within the collar insert 81 and the arms form a snap fit engagement with the neck portion 104. In this position, the collar insert 81 becomes loosely sandwiched between underside of the lower circumferential flange 104*b* on the neck portion 104 of the keg 100 and the upper surface 15 of the mounting portion 11 of the top chime 10.

When positioned between the circumferential flange 104*b* and the top chime 10, the collar insert 81 is rotated over an angle of about 180° with respect to the longitudinal axis of the top chime 10. As a result, the open side of the collar insert 81 again faces the access aperture 23, but now from the inside of the chime 10. Also in this position, the collar insert 81 is sandwiched between the circumferential flange 104*b* of the neck portion 104 and the upper surface 15 of the mounting portion 11 of the top chime 10.

When the collar insert 81 is in the rotated position, the collar 30 is inserted through the access aperture 23in the same way as described above with reference to FIGS. 5*a*, 5*b* and 6. Then, the collar 30 is inserted in between the collar insert 81 and the circumferential flange 104*b* of the neck 104. When also the arms of the collar 30 snap around the neck 104 of the keg 100, the collar 30 and the collar insert 81 together surround the full circumference of the neck 104 and are sandwiched between the circumferential flange 104*b* and the top chime upper surface 15. The collar 30 may then be axially locked by the lock formation 17 as described before.

It is noted that, if the upper surface 15 of the mounting portion is designed such that the collar insert 81 can be inserted through the access aperture 23 at the opposite side of the top chime 10 and brought into its position between the circumferential flange 104*b* and said upper surface 15, the rotation step can be omitted.

Figure 7A:
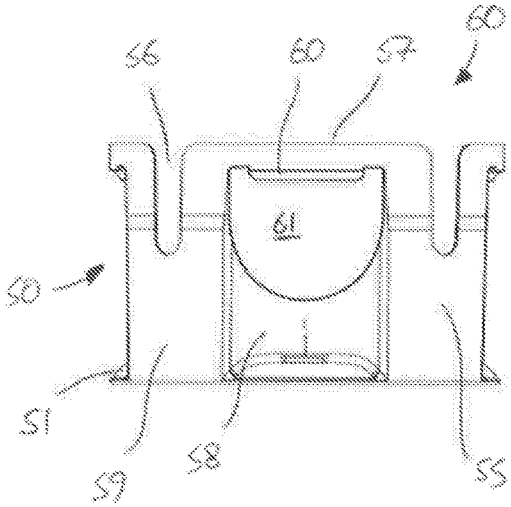
FIGS. 7*a* to 7*d* illustrate the bottom chime in isolation.
Figure 7B:
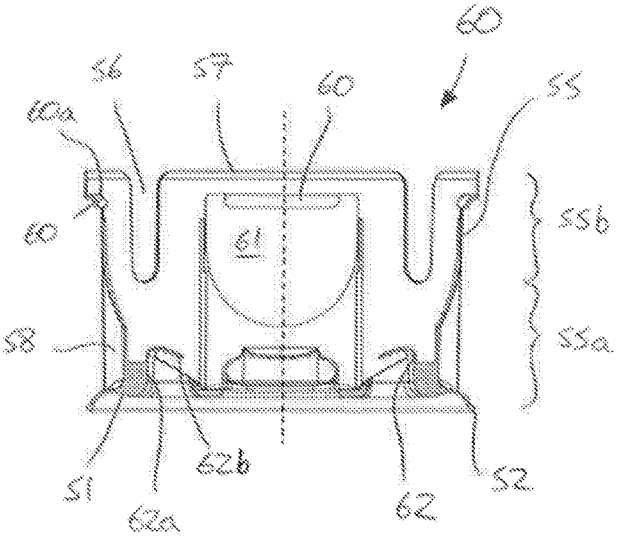
Figure 7C:
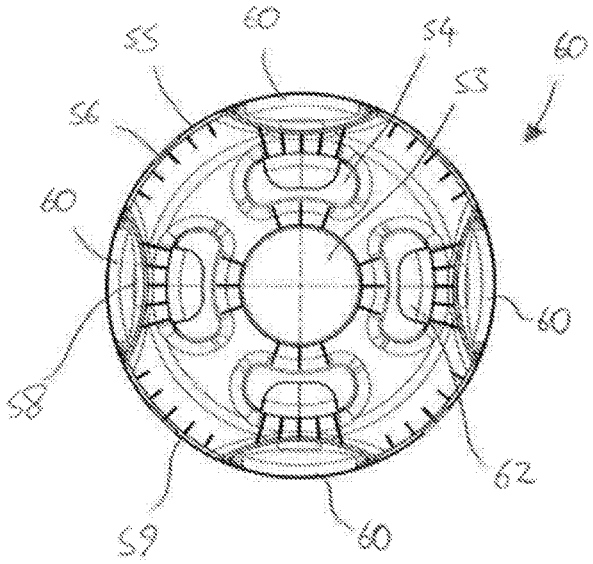
Figure 7D:
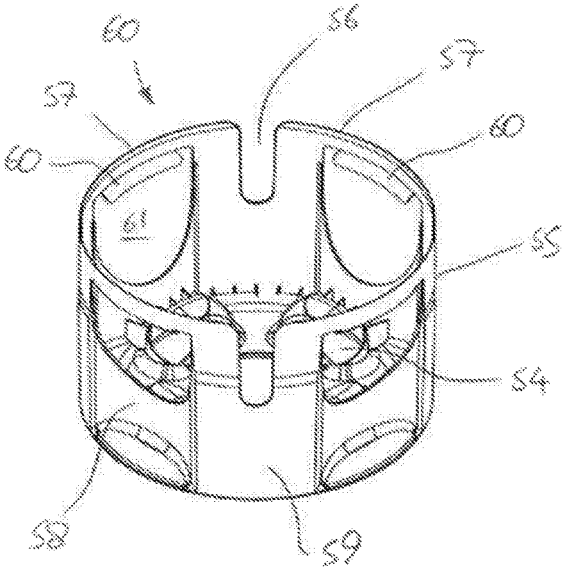

The bottom chime 50 is illustrated in isolation in FIGS. 7*a* to 7*d*, in which FIG. 7*a* illustrates a side view of the bottom chime, FIG. 7*b* illustrates a cross-section view through the bottom chime, FIG. 7*c* illustrates a plan view from above the bottom chime, and FIG. 7*d* illustrates a perspective view of the bottom chime.

The bottom chime 50 comprises a generally annular base section 51 that extends across the bottom chime 50 at the lower end thereof. The base section 51 includes a downwardly extending lower rim 52 on which the bottom chime 50 is configured to sit in use, and an annular groove located inboard of the lower rim 52 that is configured to receive the crown portion 18 of a top chime 10 in order to facilitate stacking of keg assemblies 1. The base section 51 comprises a central aperture 53 formed therethrough. The base section 51 further comprises a set of four handle apertures 54 that are spaced apart around the central aperture 43 in proximity to an outside edge of the base section 51 and configured to be gripped by a user, for example to facilitate chest carrying of the keg assembly 1.

The bottom chime 50 further comprises a substantially annular sleeve or outer wall 55 that extends upwardly from the base section 51. The base section 51 and the sleeve 55 together define a socket that is configured to receive and surround the base portion 101 of the keg 100 when the bottom chime 50 has been mounted to the keg 100, as illustrated in FIGS. 1*a* to 1*d*.

The sleeve 55 includes a lower section 55*a* that extends continuously around the circumference of the bottom chime 50, and an upper section 55*b* that includes a set of four through slots 56 that extend downwardly from a top end of the sleeve 55 to divide the upper section 55*b* of the sleeve into four circumferentially spaced tabs 57.

The lower section 55*a* of the sleeve includes a set of four depressions 58 that are spaced apart around the circumference of the bottom chime 50 and each extend inwardly with respect to the overall contour of the sleeve 55. The depressions 58 are aligned with the handle apertures 54 and facilitate gripping of the bottom chime 50 through the handle apertures 54. Each depression 58 provides a lower lip at its base that may be gripped by a user, for example to assist with removal of the bottom chime 50 from the keg 100 as described below. The depressions 58 are separated by outer pillar portions 59 that substantially follow the outer contour of the sleeve 55. The slots 56 extending from the upper end of the sleeve 55 are aligned with the outer pillar portions 59.

The bottom chime 50 comprises a set of four engagement elements 60 that are provided adjacent to the top end of the sleeve 55 on the respective tabs 57 forming the upper section 55*b* of the sleeve 55. Each engagement element 60 extends radially inwardly from its respective tab 57, and is elongate in a circumferential direction with respect to the bottom chime 50, extending substantially across the width of its respective tab 57. Each engagement element 60 has a curved, ramped upper surface 60*a*, and a hooked underside.

Each tab 57 is provided with an aperture 61 or through hole located axially below its respective engagement element 60. The apertures 60 facilitate inclusion of the depressions 58 since the base portion 101 of the keg 100 is able to protrude through the apertures 61 between the depressions 58 and the engagement elements 60, as well as allowing inspection of the bottom part of the keg 100 when the bottom chime 50 has been mounted to the keg 100.

The bottom chime 50 further comprises a set of four resiliently deformable support elements 62 that are configured to engage the underlying contour of the base portion 101 of the keg 100 between the feet 101*a* when the bottom chime 50 has been mounted to the keg 100 in order to support the weight of the keg 100. Each support element 62 comprises a connecting strut 62*a* that extends upwardly from the base section 51 of the bottom chime 50, and a support portion 62*b* that extends radially inwardly from an upper end of the connecting strut 62*a*. The support portions 62*b* each provide an upwardly facing contact surface for engaging the base portion 101 of the keg 100. The contact surfaces are shaped to match the underlying contour of the base portion 101 of the keg 100 between the feet 101*a*.

The support elements 62 are connected to the base section 51 adjacent to and radially outboard of the handle apertures 54, and the connecting struts 62*a* of the support elements 62 each provide an inner surface for a respective one of the handles 54. The connecting struts 62*a* of the support elements 62 are each connected to the outer wall of the sleeve 55 by a plurality or reinforcing webs in order to provide reinforcement to the handles.

The bottom chime 50 is configured to be push fitted to the bottom end of the keg 100 after the keg 100 has been formed (for example by blow moulding), but preferably before the keg 100 has been pressurised and filled with beverage. In particular the bottom chime 50 may be push fitted to the bottom end of the keg 100 by lowering the keg 100 into the bottom chime 50 while the bottom chime 50 is resting on the floor or another appropriate surface. Before the keg 100 is lowered into the bottom chime, the keg 100 is preferably oriented with respect to the bottom chime 50 with the feet 101*a* aligned with the slots 56, in which state the retaining recesses 110 provided on the body of the keg 100 are aligned with the respective engagement elements 60 of the bottom chime 50.

Once the keg 100 has been correctly oriented with respect to the bottom chime 50, the keg 100 may then be lowered into the bottom chime 50. The slots 56 may act to guide the feet 101*a* with respect to the bottom chime 50. When the base portion 101 of the keg 100 impacts the ramped upper surfaces 60*a* of the engagement elements 60, the tabs 57 on which the engagement elements 60 are provided are deflected radially outwardly in order to allow the keg 100 to proceed into its fully mounted position with respect to the bottom chime 50.

When the keg 100 reaches its fully mounted position with respect to the bottom chime 50, as illustrated in FIGS. 1*a* to 1*d*, the engagement elements 60 of the bottom chime 50 move radially inwardly into the corresponding retaining recesses 110 provided on the body of the keg 100 to form a snap-fit engagement. In this coupled state the engagement elements 60 of the bottom chime 50 prevent axially outward movement of the bottom chime 50 with respect to the keg 100 such that the bottom chime 50 is securely retained at the base of the keg 100.

The bottom chime 50 is configured to remain securely mounted to the keg 100 as long as the keg 100 remains pressurised. However, after the keg 100 has been depressurised following the dispensing of beverage the keg becomes less stiff, and the bottom chime 50 may then be manually removed from the keg 100 without requiring the use of any specific tools and without damaging the bottom chime 50 by pulling the bottom chime 50 in an axially outward direction with respect to the keg 100. It is then possible to dispose of the keg 100, for example by crushing and recycling the keg, while the bottom chime 50 may be recycled separately to the keg as part of a one-way keg system. If the bottom chime 50 can be removed from the keg without becoming significantly damaged then it may additionally be possible to retain or return the bottom chime 50 for subsequent use with another keg.

The top chime 10, the collar 30 and the bottom chime 50 may each be injection moulded plastic components, and may each be formed of, for example high density polyethylene, polypropylene or nylon, although other materials are also possible.

Many modifications may be made to the above examples without departing from the scope of the present invention as defined in the accompanying claims.

For example, in the above-described embodiment the collar is configured to be passed through an access aperture formed in a side face of the top chime and moved in a direction perpendicular to the longitudinal axis of the top chime until it reaches a fully mounted position in which it surrounds the neck portion of the keg. However, in other embodiments the collar may instead be configured to be assembled together with the top chime by first passing the collar downwardly through the opening formed at the top of the crown portion before moving the collar radially inwardly into engagement with the neck portion of the keg. In other embodiments the mounting element need not surround the neck portion of the keg, and the collar described above may instead be replaced by a plurality of separate mounting elements that each engage the underside of the lower circumferential flange of the neck portion at respective locations spaced apart around the mounting portion of the top chime.

In the above-described embodiment the keg has four feet and the bottom chime includes sets of four slots, tabs, engagement elements, depressions and handles. However, in other embodiments the keg may have a different number of feet or no feet, and the bottom chime may include a different number of slots, tabs, engagement elements, depressions and handles.

While the above-described embodiment relates to a keg assembly including both a top chime and a bottom chime it will be appreciated that in other embodiments the keg assembly may include a keg and a top chime only or a keg and a bottom chime only.

Other modifications and variations will also be apparent to the skilled person.

The invention claimed is:

1. A top chime configured to be mounted to a keg; wherein the top chime comprises:

a mounting portion for mounting the top chime to the keg in use, the mounting portion defining an aperture that is configured to receive a neck portion of the keg;

wherein the top chime is configured to be removable from the keg after having been mounted to the keg by pulling the top chime in an axially outward direction with respect to the keg, the top chime being provided with a mounting element, supplied together with the top chime as a separate component, that is configured to engage the mounting portion to thereby secure the top chime with respect to the keg, and wherein the mounting element is configured to be assembled together with the top chime by moving the mounting element in a radially inward direction with respect to a longitudinal axis of the top chime.

2. A top chime according to claim 1, wherein the mounting element is configured to be assembled together with the top chime by moving the mounting element in a direction that is at least substantially perpendicular to the longitudinal axis of the top chime.

3. A top chime according to claim 1, wherein the mounting element is configured to be assembled together with the top chime by sliding the mounting element into a mounted position with respect to the top chime.

4. A top chime according to claim 1, wherein the top chime comprises an access aperture provided in a side face thereof, wherein the mounting element is configured to pass through the access aperture in order to be assembled together with the top chime.

5. A top chime according to claim 1, wherein the mounting element is configured to be assembled together with the top chime after the top chime has been moved into a mounted position with respect to the keg.

6. A top chime according to claim 1, wherein the mounting element is configured to engage a bearing surface of the mounting portion to thereby secure the top chime with respect to the keg in use.

7. A top chime according to claim 1, wherein the mounting element comprises a collar that is configured to at least partially surround the neck portion of the keg.

8. A top chime according to claim 7, wherein the mounting element is configured to receive the neck portion of the keg with a snap fit engagement.

9. A top chime according to claim 1, wherein the top chime comprises a lock formation that is configured to retain the mounting element in a mounted position with respect to the top chime.

10. A top chime according to claim 1, wherein the mounting portion of the top chime comprises a plurality of tines that extend radially inwardly into the aperture.

11. A top chime according to claim 1, wherein the top chime comprises a plurality of contact elements that are configured to engage an upper shoulder portion of the keg in use, the contact elements comprising a plurality of resiliently deformable contact elements that are configured to be resiliently deformed and to bear against the upper shoulder portion of the keg and/or a plurality of feet that are spaced apart around an outer edge of the top chime.

12. A top chime according to claim 1, further being provided with a second mounting element, the second mounting element being configured to be assembled together with the top chime by moving the second mounting element in a radially inward direction with respect to a longitudinal axis of the top chime, in such a way that the mounting element and the second mounting element together form a collar that surrounds the neck portion of the keg.

13. A top chime according to claim 12, wherein the mounting portion of the top chime comprises a plurality of tines that extend radially inwardly into the aperture, the mounting element and the second mounting element being configured to be mounted in such a way that they are together sandwiched between the tines and a circumferential flange on the neck portion of the keg.

14. A keg assembly or kit of parts for forming a keg assembly comprising a keg or a preform for forming a keg and a top chime according to claim 1 that is mounted to the keg or configured to be mounted to the keg.

15. A top chime configured to be mounted to a keg, the top chime having a mounting portion for mounting the top chime to the keg in use;

wherein the mounting portion comprises a plurality of resiliently deformable contact elements that are circumferentially spaced apart around the mounting portion and that are configured to be resiliently deformed and to bear against an upper shoulder portion of the keg when the top chime is mounted to the keg.

16. A top chime according to claim 15, wherein the contact elements are connected to the mounting portion inboard of an outer edge of the mounting portion, wherein the contact elements are connected to the mounting portion adjacent to an aperture formed through the mounting portion that is configured to receive a neck portion of the keg in use, and wherein the contact elements extend downwardly and radially outwardly from the mounting portion.

17. A top chime according to claim 15, wherein the contact elements each have a curved shape that curves radially outwardly along a direction away from the mounting portion, wherein each contact element defines a contact surface that is configured to bear against the upper shoulder portion of the keg, and wherein the contact surfaces are shaped and/or angled to compliment the contour of the upper shoulder portion of the keg.

18. A top chime according to claim 15, further comprising a second set of contact elements that are configured to engage the upper shoulder portion of the keg and that are located radially outboard of the resiliently deformable contact elements.

19. A kit of parts for forming a keg assembly, the kit comprising:

a keg or a preform for forming a keg, and a top chime that is configured to be mounted to the keg; wherein the top chime comprises a mounting portion for mounting the top chime to the keg in use;

wherein the mounting portion defines an aperture that is configured to receive a neck portion of the keg and comprises a plurality of resiliently flexible tines that extend radially inwardly into the aperture, the configuration being such that the tines permit manual removal of the top chime from the keg after the top chime has been mounted to the keg and wherein the tines are configured to permit removal of the top chime from the keg without damaging the top chime.

20. A kit according to claim 19, wherein each tine comprises a curved or kinked region or a region of reduced thickness, wherein the tines are each substantially planar and/or each extend in a plane that is perpendicular to a longitudinal axis of the top chime, and wherein the radially inner distal ends of the tines are shaped to compliment the shape of the neck portion of the keg.

* * * * *